US006196867B1

(12) United States Patent
Kawase et al.

(10) Patent No.: US 6,196,867 B1
(45) Date of Patent: Mar. 6, 2001

(54) FITTING DETECTING CONNECTOR

(75) Inventors: Hajime Kawase; Satoru Nishide; Ryotaro Ishikawa, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/357,890

(22) Filed: Jul. 21, 1999

(30) Foreign Application Priority Data

Jul. 22, 1998 (JP) ..... 10-206802

(51) Int. Cl.[7] ..... H01R 3/00
(52) U.S. Cl. ..... 439/489; 350/352
(58) Field of Search ..... 439/489, 352, 439/350, 351, 353, 357, 358, 188

(56) References Cited

U.S. PATENT DOCUMENTS 5,183,410 2/1993 Inaba et al. ..... 439/489
5,820,399 * 10/1998 Shirouzu et al. ..... 439/352

* cited by examiner

*Primary Examiner*—Paula Bradley
*Assistant Examiner*—Alexander Gilman
(74) *Attorney, Agent, or Firm*—Banner & Witcoff, Ltd.

(57) ABSTRACT

When two connector housings are half fitted together, a fitting detecting connector causes one of the connector housings to be pushed in a direction of separation by means of springs which are provided within a female connector housing 5, a spring holder 15 being inserted into this female connector housing 5 so that it can move in an anterior-posterior direction. This spring holder 15 houses coiled springs 16 and, when the two connector housings are being fitted together, a locking arm 11 rises over a stopping protrusion 2. As a result of this rising up the spring holder 15 is engaged, its movement in a posterior direction is regulated, and the coiled springs 16 are compressed. When the connector housings are completely fitted together the locking arm 11 again moves, releasing the engagement of the spring holder 15, and the spring holder 15 is pushed in a posterior direction by the spring force. In this way the separating force does not act when the connector housings are fully engaged.

14 Claims, 11 Drawing Sheets

FITTING DETECTING CONNECTOR

TECHNICAL FIELD

The present invention relates to an electrical fitting detecting connector.

BACKGROUND TO THE INVENTION

Conventional fitting detecting connectors have male and female parts. When the fitting operation of male and female connectors is carried out, a spring built into one of the connector housings is compressed. If the fitting operation ceases before the two connector housings are completely fitted together, the corresponding connector housing is pushed out by the spring, and this informs the operator that a correct fitting has not been achieved.

In a completely fitted state however, the spring force continues to act so that a force to separate the two housings is continually being exerted, and this is not desirable. Accordingly, connectors have been developed in which the spring is compressed during the fitting operation and reverts to its uncompressed shape when the fitting is complete. For example, one such connector is described in JP-92-306575.

If the spring detects the completely fitted state and is then released, the easiest configuration to adopt is one in which the fitting detection is carried out by using the movement of a locking arm. In such cases, as is the case in the Publication mentioned above, the locking arm and the spring are arranged in a distributed manner, so that locking arm is located in one connector, and the spring is located in the other.

Accordingly, in order to realise this kind of detecting connector, a necessary constituent of each connector housing is at least a locking arm or a spring. However, this places constraints on the configuration of the connector housings. For example, if an existing connector housing is to be replaced with one of a fitting detecting type, major design changes will have to be carried out on both the male and female connector housings.

The present invention has been developed after taking the above problem into consideration, and aims to present a fitting detecting connector which has a greater degree of design freedom.

SUMMARY OF THE INVENTION

According to the invention there is provided a connector housing of a male/female connector pair, the housing including a locking arm bendable from a rest condition to a bent condition on initial engagement with a locking member of a mating connector, and reverting to the rest condition on complete engagement of said locking arm and locking member, the housing further including a compression spring having one end engageable with a mating connector to urge said housing out of engagement therewith during partial fitting thereof, and a spring holder defining a releasable reaction member for the other end of said spring, said reaction member being effective during partial fitting, and being released on complete engagement of said locking arm and locking member, thereby permitting compressive stress in said spring to be reduced.

Preferably the spring holder is movable with respect to said housing in the direction of fitting thereof from an advanced to a retreated position, the locking arm being engageable with said spring holder in the bent condition to restrain movement thereof relative to said housing, and thereby make said reaction member effective, the locking arm disengaging said spring holder on reverting to the rest condition and permitting movement thereof to the retreated position.

In a preferred embodiment, the spring holder includes a bending regulating member adapted to prevent bending of said locking arm from the rest condition on complete engagement of said locking arm and locking member.

Preferably the spring holder overlies said locking arm and has a bendable member adapted to contact an abutment of said locking arm, to bend said locking arm from the rest to the bent condition.

In a preferred embodiment the bendable member includes a pushing face for receiving a bend inducing force, the plane of said face intersecting the direction of movement of said spring holder and the direction of movement of said abutment.

The bendable member may include a recess within which is located said pushing face said recess being adapted to guide an elongate release tool.

Preferably the spring holder and housing are guided with respect to each other by opposite ribs of one of the spring holder and housing, and opposite channels of the other of the spring holder and housing, said channels and ribs interengaging.

The channels may be narrowed at the end thereof corresponding to the retreated position.

The spring holder may further include latching latching means engageable with said housing to maintain said spring holder in the advanced position, said latching means being released on complete engagement of said locking arm and locking member.

Preferably the spring is a coil spring, said one end of said spring having a seat engaged therewith, and said seat being adapted to contact a mating connector.

A plurality of coil springs may be provided, each having a seat, and each seat may be pressed into the end of the spring and be retained by deformable coil engaging ribs of the seat.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Embodiments of the present invention are described below with the aid of figures.

Figure 1:
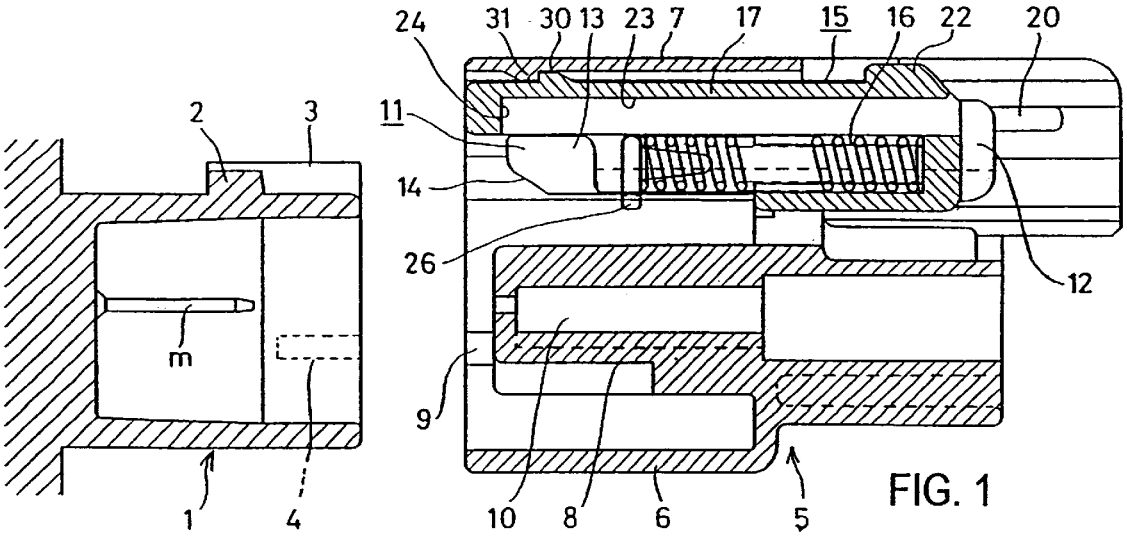
FIG. 1 is a cross-sectional view of two connector housings of a first embodiment of the present invention prior to their being fitted together.

A first embodiment of the present invention is described below with the aid of FIGS. 1 to 17. In FIG. 1, the number 1 refers to a male connector housing which is directly connected to an electrical apparatus. This male connector housing 1 is of an approximately angular tubular shape, is open at the front, and its interior houses a male terminal fitting m. A stopping protrusion 2 protrudes from its upper face at a location close to its anterior edge. A pair of ribs 3 is provided on both sides of the stopping protrusion 2. These ribs 3 extend in a parallel fashion from the opening edge of the male connector housing 1 to the posterior edge of the stopping protrusion 2.

In addition, a pair of guiding protruding edges 4 are formed on both side faces of the male connector housing 1 in order to prevent twisting when a female connector housing 5 is fitted.

Next, an explanation is given of the female connector housing 5 which can be fitted to the male connector housing 1 described above. The male and female connector housings 1 and 5 are each formed in a unified manner from plastic, and the anterior half of the female connector housing 5 is larger than the posterior half and is open towards the anterior side, forming an external cylinder member 6. The central portion of the upper face of the external cylinder member 6 protrudes in an upper direction and forms an arch-shaped bridge member 7.

Figure 2:
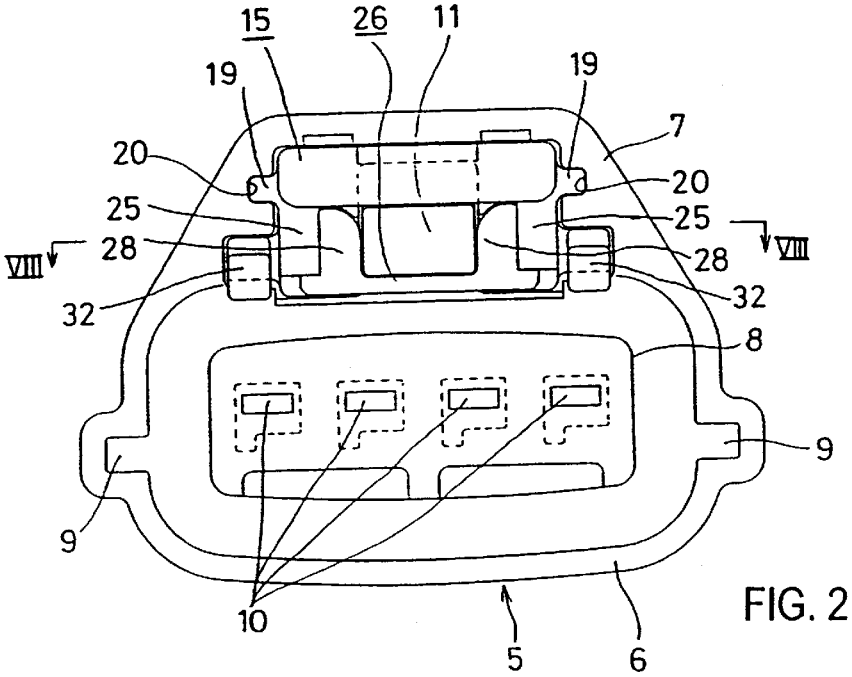
FIG. 2 is a front view of a female connector housing.

As shown in FIG. 2, a terminal housing member 8 is provided with four terminal housing chambers 10 aligned in a parallel manner in a width-wise direction, and at a specified distance from one another. Each terminal housing chamber 10 passes through from the anterior to the posterior, and can house female terminals in a latched state. When the male connector housing 1 and the female connector housing 5 are in a completely fitted state, the male and female terminals are connected electrically.

Figure 3:
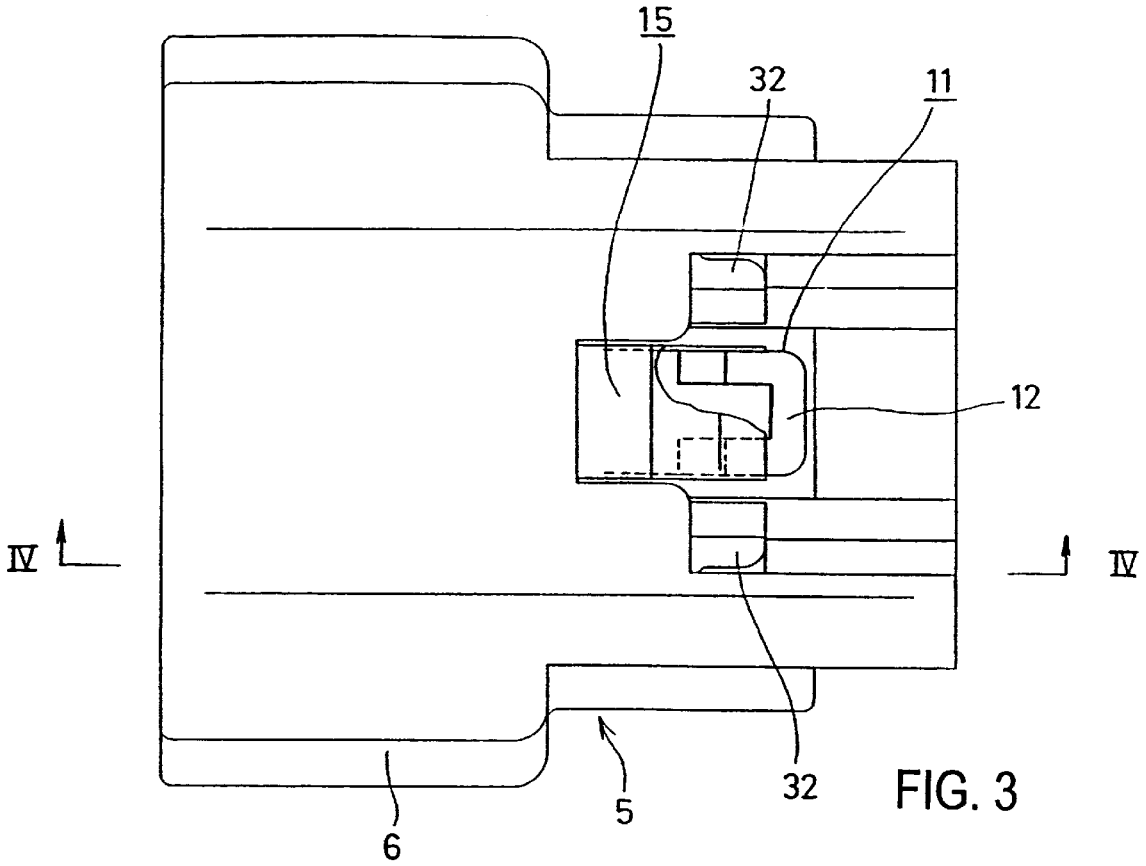
FIG. 3 is a plan view of the female connector housing.
Figure 4:
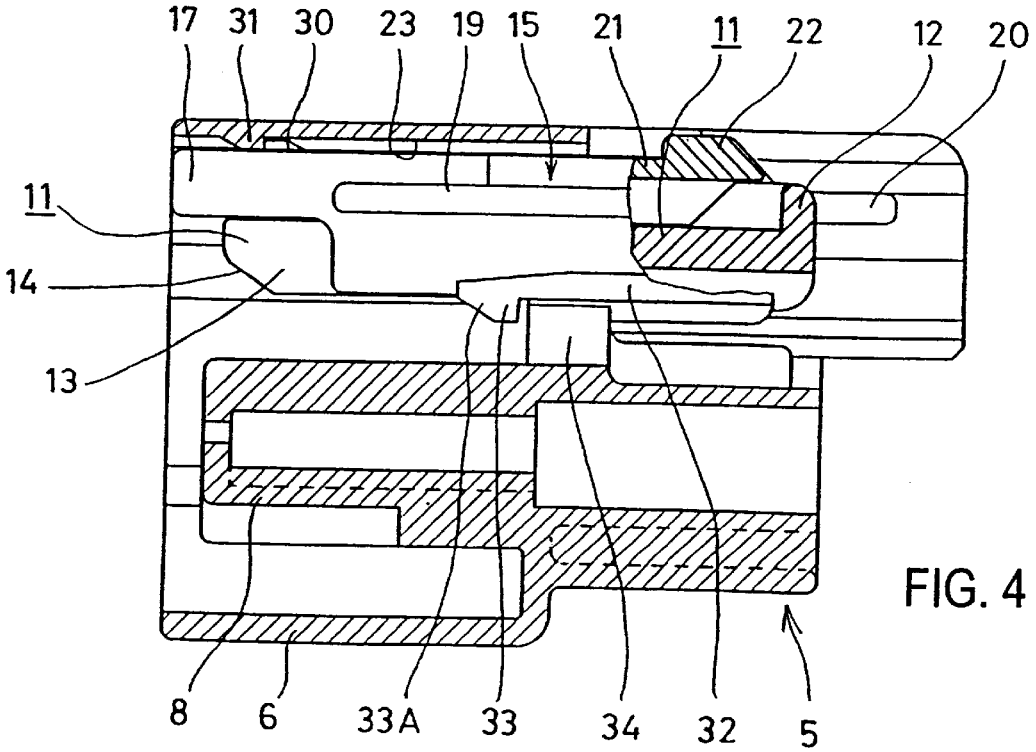
FIG. 4 is a cross-sectional view of FIG. 3 along the line IV—IV.
Figure 5:
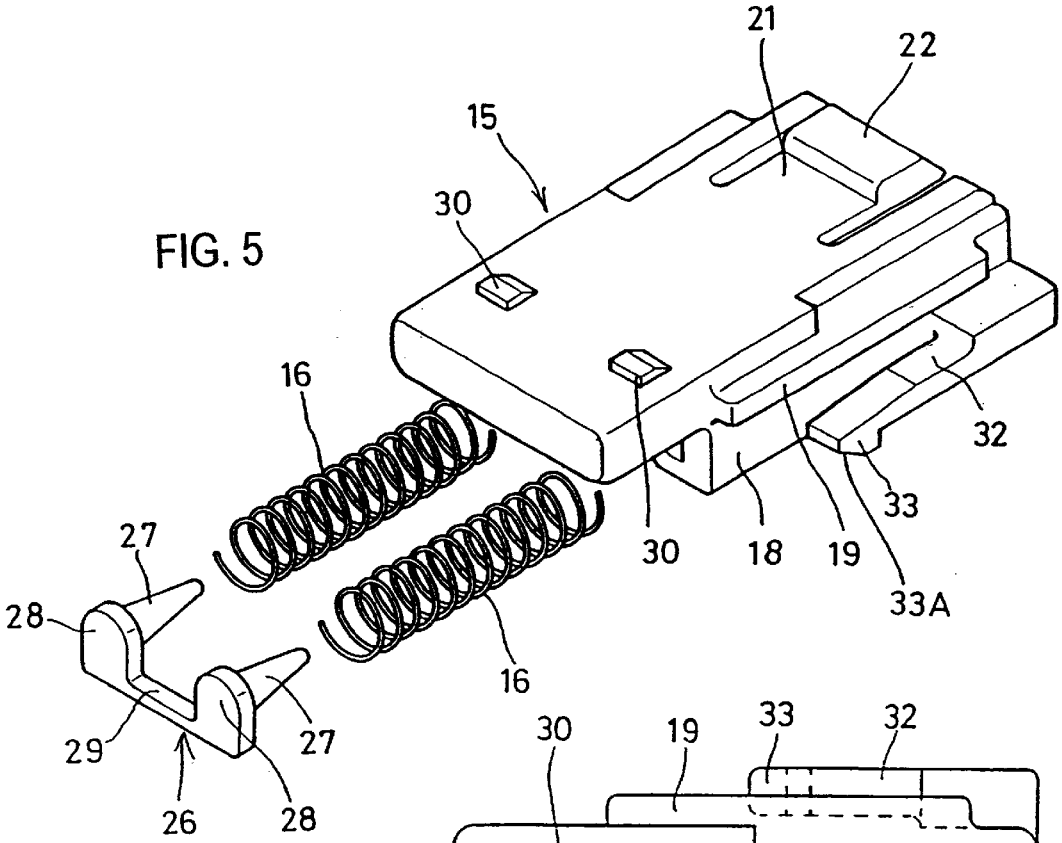
FIG. 5 is an exploded diagonal view of a spring holder.

A locking arm 11 is provided on the upper face of the terminal housing member 8 to support the two connector housings in a fitted state, the anterior half thereof extending into the bridge member 7, and the upper face of the posterior end thereof having a rising C-shaped edge 12 which follows along its external edge (see FIGS. 3 and 4). The approximately central portion of the locking arm 11 is joined to the upper face of the terminal housing member 8 and the locking arm 11 can be moved in a seesaw fashion in the anterior and posterior directions. The anterior end of the locking arm 11 has a hook-shaped locking claw 13. When the two connector housings are in a completely fitted state, this locking claw 13 fits with and is retained by the stopping protrusion 2, and the connector housings are maintained in a fitted state. In addition, the anterior end face of the locking claw 13 has a tapered face 14 which tapers towards the inner side, and which allows the locking claw 13 to rise smoothly over the stopping protrusion 2 in the connecting direction.

A spring holder 15 is formed on the female connector housing 5 to cover the locking arm 11 (see FIGS. 5 to 8). When this spring holder 15 contains coiled springs 16 (to be described later), it becomes a unit, and the spring holder 15 and the coiled springs 16 are contained as a unit within the female connector housing 5. The spring holder 15 has a plate shaped base plate member 17. A pair of spring housing members 18 extend from front to rear on the left and right sides of the lower face of this base plate member 17 and serve to clamp the locking arm 11.

A pair of guiding rails 19 extend for a specified length along both sides of the spring holder 15 from a position part-way along the sides of the spring holder 15 towards the rear. Concave groove members 20 provided on the inner face of the bridge member 7 of the female connector housing 5 correspond with the guiding rails 19, and allow the guiding rails 19 to be fitted in such a way that they can slide. The guiding rails 19 extend from the anterior end face of the bridge member 7 in an anterior-posterior direction for a specified length. When the spring holder 15 is fitted into the female connector housing 5, the stroke of the guiding rails 19 in the posterior direction is regulated by the posterior edge location of these groove members 20.

Figure 6:
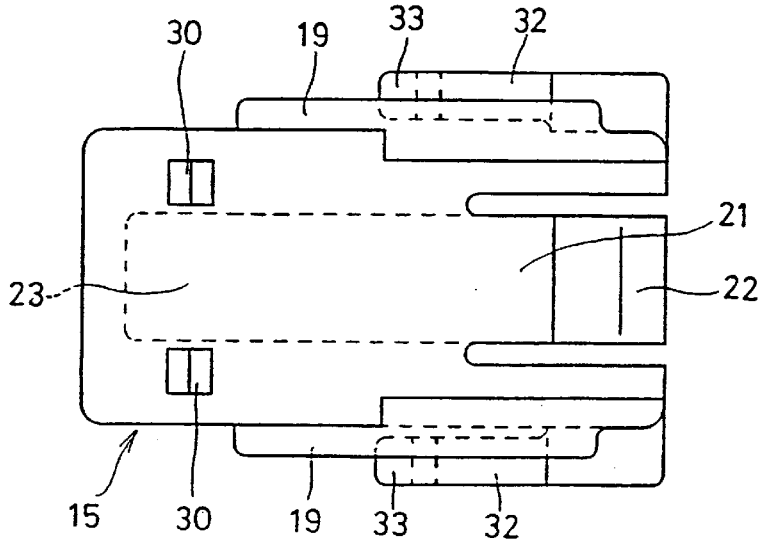
FIG. 6 is a plan view of the spring holder.
Figure 7:
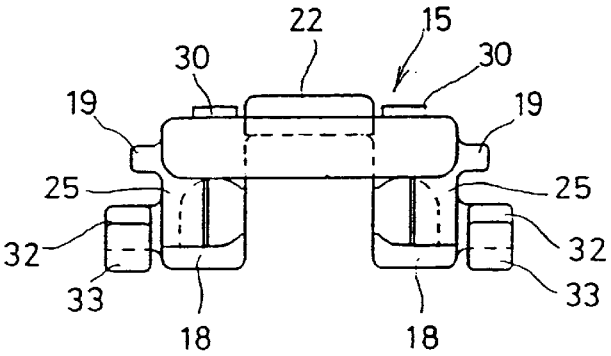
FIG. 7 is a front view showing a single spring holder prior to it being fitted with a coiled spring.
Figure 8:
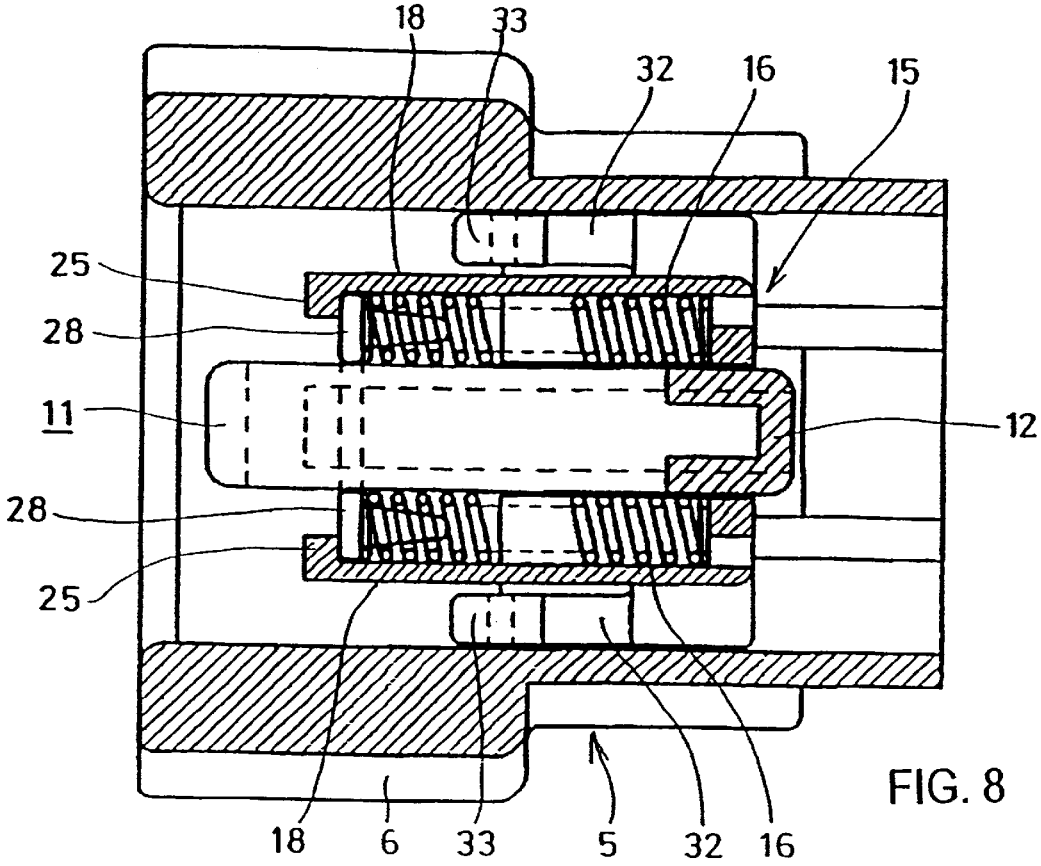
FIG. 8 is a cross-sectional view of FIG. 2, along the line VIII—VIII.

The spring holder 15 is usually fitted so that it covers almost the entire length of the locking arm 11 with only the posterior end portion of the locking arm 11 protruding slightly. A releasing operating member 21 is formed on the posterior edge of the locking arm 11, that is, on the portion on which the rising edge 12 is formed and which corresponds to the lock releasing side, this releasing operating member 21 allowing the lock release of the locking arm 11 to be carried out. The anterior end portion of the releasing operating member 21 is higher and forms a stepped member 22. As shown in FIG. 6, slots have been made along both sides of the releasing operating member 21 which allow it to bend in an up-down direction. Additionally, as shown in FIG. 4, the lower face of the releasing operating member 21 is usually in contact with the rising edge 12 of the locking arm 11 and allows a pushing-in operation to be performed on the locking arm 11.

The inner face of the base plate member 17 has the same width as the releasing operating member 21 and has a recessed concave member 23 set back from the anterior edge. This recess 23 allows the locking arm 11 to bend when it rides over the stopping protrusion 2 while the two connector housings are being fitted together. The anterior end of the base plate member 17 forms a restraining wall 24 which engages the anterior end of the locking member 11 and regulates the retreating operation of the spring holder 15 (explained in detail later).

The interior of each spring housing member 18 houses a coiled spring 16 horizontally and in an approximately natural state. Only half of the anterior face of the spring housing member 18 is open. That is, a pair of halting members 25 are formed on the anterior ends of the spring housing members 18, these halting members 25 covering half of the external face of each spring housing member 18. The anterior ends of the two coiled springs 16 are equipped with a spring pushing member 26.

This spring pushing member 26 comprises a pair of spring seats 28, each of which has an axis member 27 which projects into the respective coiled spring 16, and a joining member 29 which links the spring seats 28. This spring pushing member 26 links the coiled springs 16 and allows them to expand and contract together. The spring seats 28 come into contact with the inner side of the halting members 25 and the removal of the coiled springs 16 is thereby prevented. The portion of the spring seats 28 which protrude from the halting members 25 corresponds to the location of the ribs 3 of the male connector housing 1 when the male and female connector housings are being fitted together. As a result, while the fitting is taking place the ribs 3 compress the coiled springs 16 via the corresponding spring seats 28.

A pair of left and right protrusions 30 are formed on the upper face of the base plate member 17 close to the anterior end thereof. These protrusions 30 fit with stopping protruding members 31 formed on corresponding locations of the ceiling face of the bridge member 7 and fix the position in an anterior direction of the spring holders 15. A pair of supporting arms 32 protrude from the outer side faces of the two spring housing members 18. The base ends of the supporting arms 32 are located at the posterior end of the spring holder 15 and the supporting arms 32 extend horizontally in an anterior direction along the side walls of the spring housing members 18 and have a cantilevered shape, the anterior ends thereof being provided with stopping claws 33. The supporting arms 32 can be bent in an up-down direction, and can be removably engaged by a pair of hook members 34 located in a corresponding position on the upper face of the terminal housing member 8. In this manner, the spring holder 15 is kept from being removed in the posterior direction.

Figure 11:
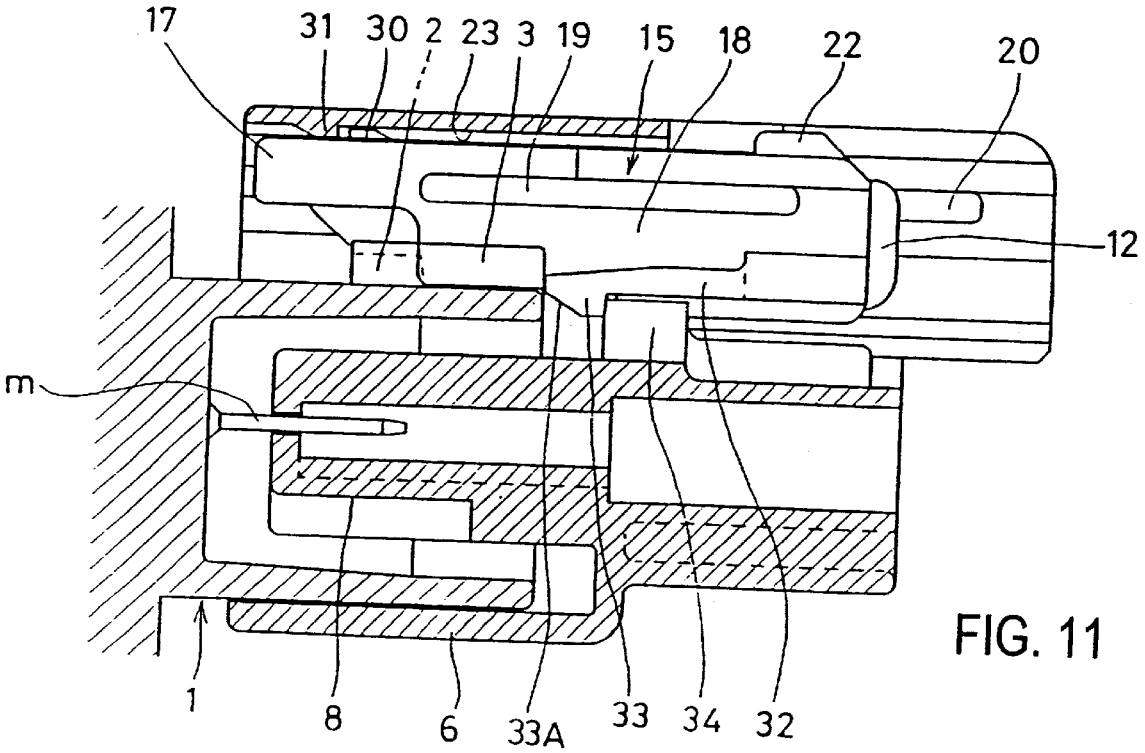
FIG. 11 is a cross-sectional view showing a supporting arm in contact with a male connector housing.
Figure 13:
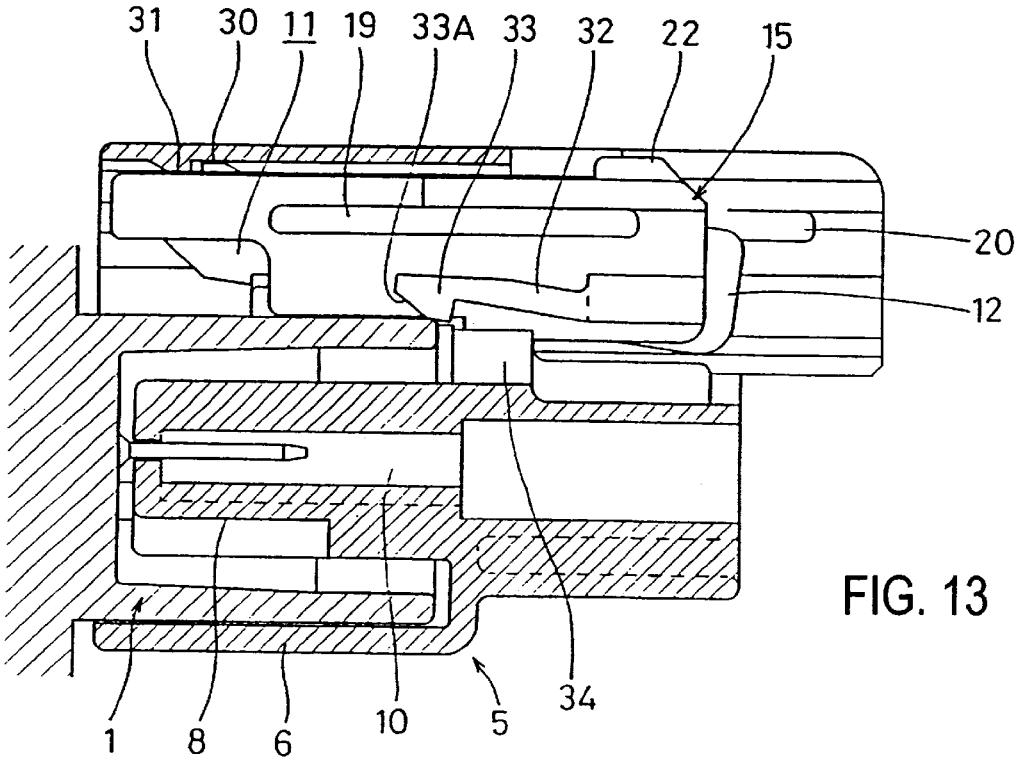
FIG. 13 is a cross-sectional view showing the supporting arm separated from the hook member.
Figure 14:
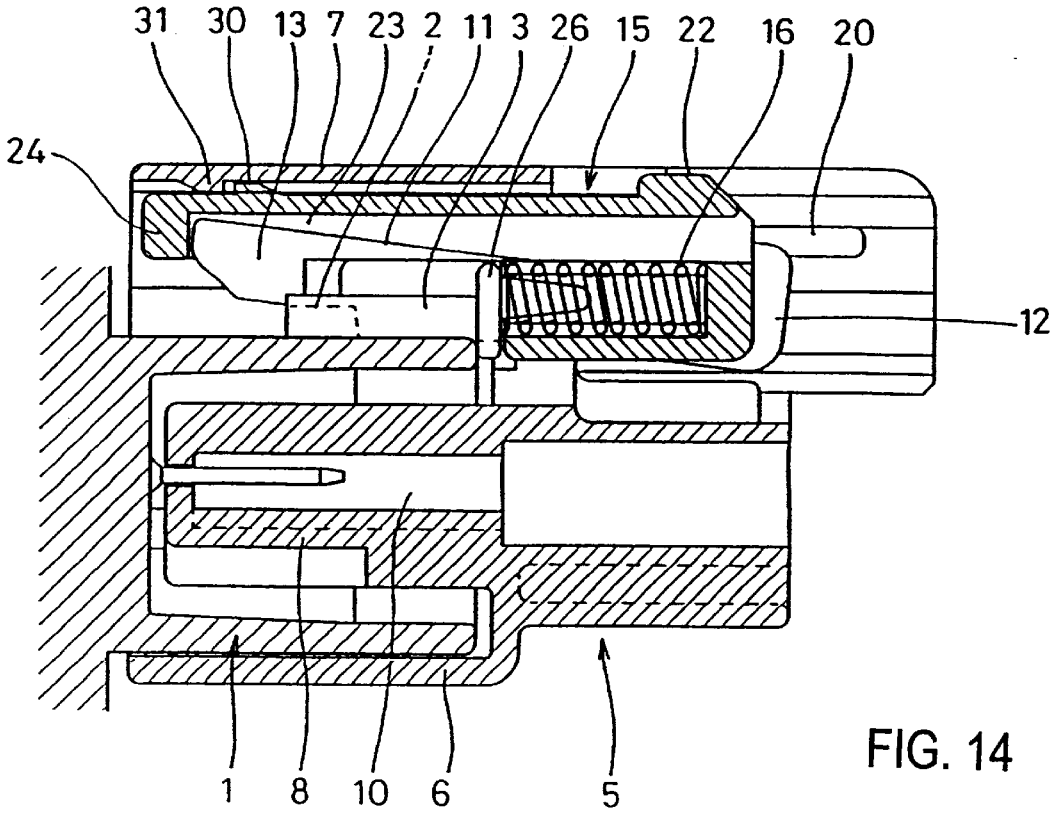
FIG. 14 is a cross-sectional view showing the movement of the supporting arm and corresponding to FIG. 13.

As shown in FIGS. 11 and 13, the stopping claws 33 of the supporting arms 32 make contact with the anterior edge of the male connector housing 1 and, as the two connector housings are fitted together, the engagement of the hook members 34 is released. This engagement is released when the connector housings are completely fitted together, and is arranged to occur just before the engagement of the spring holder 15 by the locking arm 11 is released (see FIG. 14). Further, the stopping claws 33 are provided with tapered faces 33A so that this releasing operation can be performed smoothly.

Next, the operation and effects of the present embodiment, configured as described above, are explained. When the male and female connector housings are to be fitted together they are made to face one another with the guiding protruding edges 4 of the male connector housing 1 and the guiding grooves 9 of the female connector housing 5 being brought together. Then the female connector housing 5 is pushed onto the male connector housing 1, and the locking claw 13 of the locking arm 11 makes contact with the stopping protrusion 2 of the male connector housing 1. Next the fitting take place and, as shown in FIG. 9, slightly after the locking claw 13 and the stopping protrusion 2 make contact, the ribs 3 make contact with the corresponding spring seats 28 of the spring pushing member 26.

Figure 9:
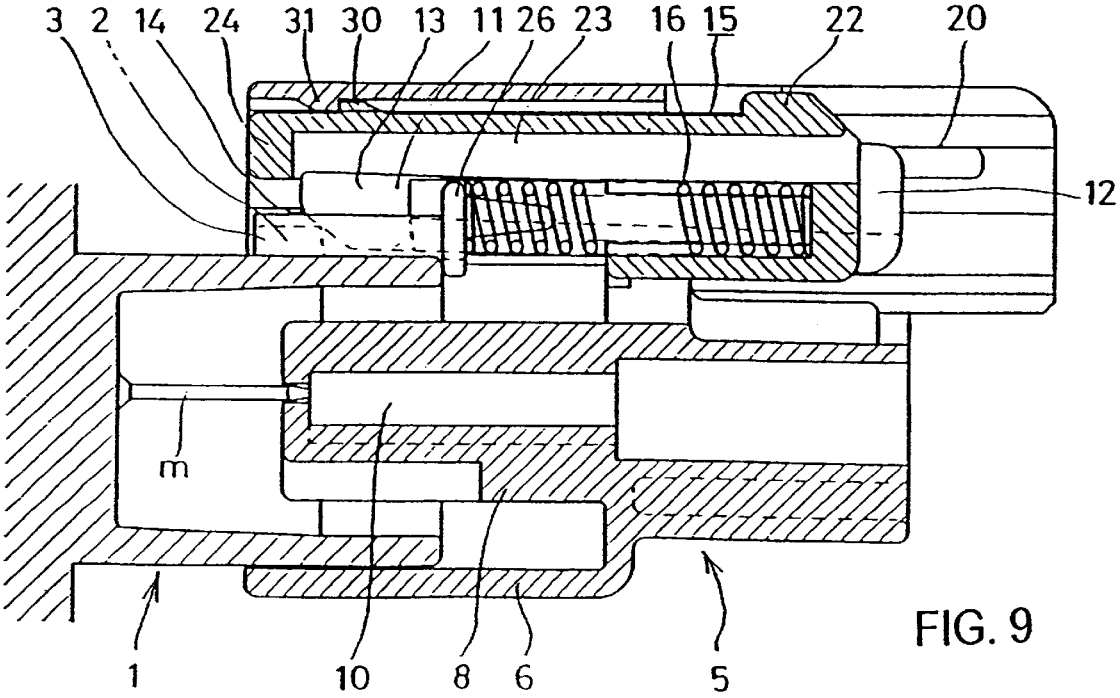
FIG. 9 is a cross-sectional view showing a locking arm in contact with a stopping protrusion.
Figure 10:
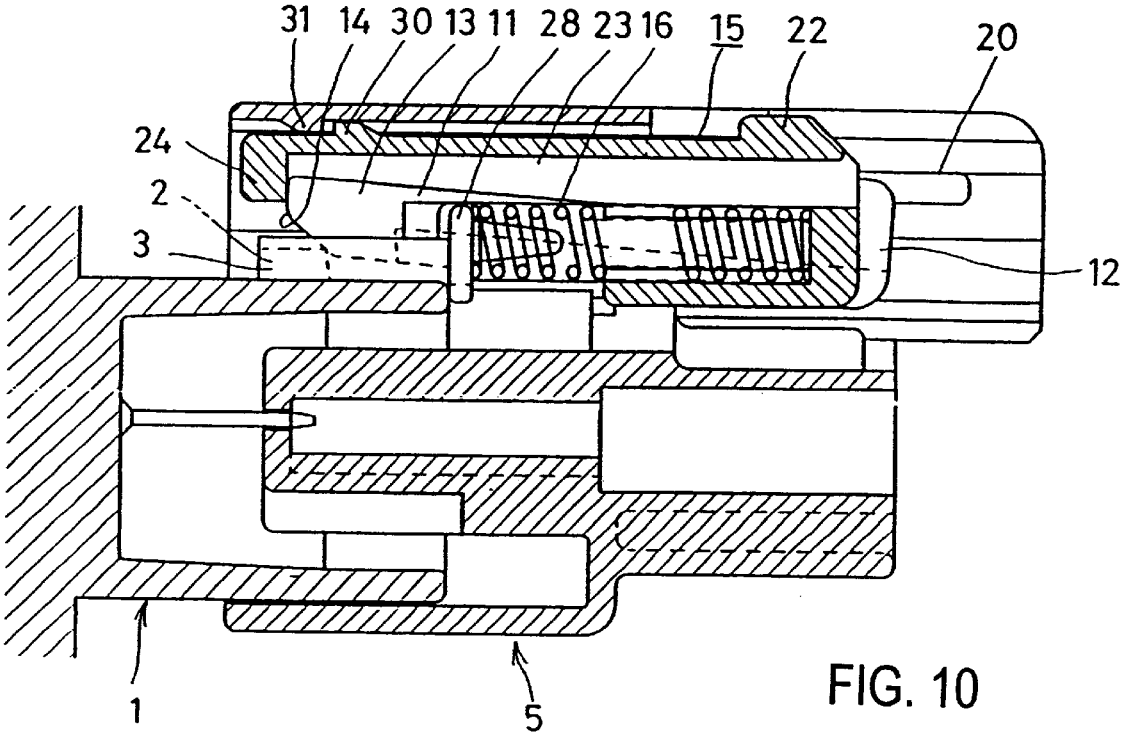
FIG. 10 is a cross-sectional view showing the locking arm which has risen over the stopping protrusion.

When the fitting operation of the connector housings is continued from the state shown in FIG. 9 the tapered face 14 of the locking claw 13 slides along the stopping protrusion 2, thus raising that side of the locking arm 11 on which the locking claw 13 is located, and the locking claw 13 thus rises over the stopping protrusion 2 (see FIG. 10). The locking claw 13 is engaged by the restraining wall 24 of the spring holder 15 as a result of the rising of the locking arm 11.

Meanwhile, the fitting operation of the ribs 3 takes place and the coiled springs 16 are pushed in by means of the spring pushing member 26. At this juncture, as mentioned above, the spring seats 28 are retained by the locking arm 11 and the restraining wall 24 and their movement in a posterior direction is thus regulated. Consequently the coiled springs 16 are restrained at their posterior end and, as a result, the coiled springs 16 begin to be compressed by the ribs 3 as the latter are pushed in. During the interval preceding the regulation of the movement of the spring holder 15 by the locking arm 11, the supporting arms 32 are in a state whereby they are stopped by the hook members 34. As a result, even if the coiled springs 16 are pushed in for any reason, the spring holder 15 will not retreat inadvertently.

Figure 12:
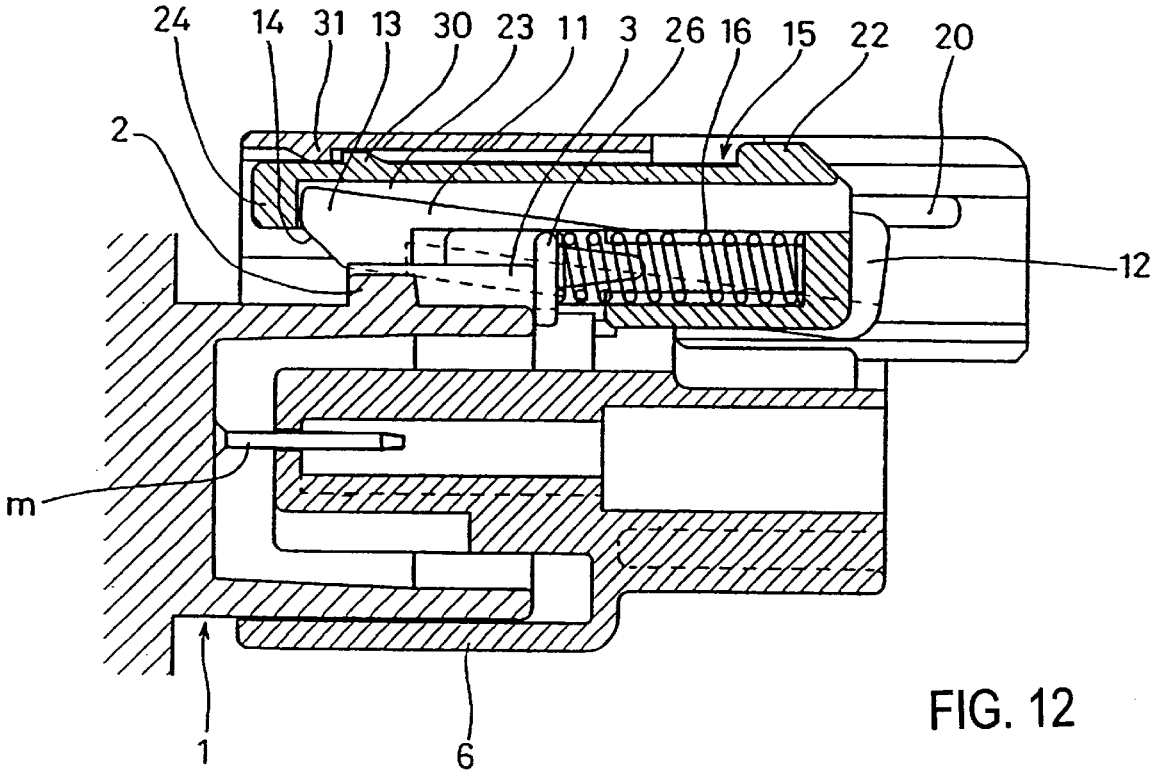
FIG. 12 is a cross-sectional view showing the movement of the locking arm and corresponding to FIG. 1.

The fitting operation of the two connector housings continues after the supporting arms 32 have been engaged by the hook members 34 (see FIGS. 11 and 12). In the state directly prior to the connector housings being completely fitted together, that is, in the state directly prior to the locking claw 13 rising over the stopping protrusion 2 (the state shown in FIG. 14), the anterior edge of the male connector housing 1 slides along the tapered face 33A of the stopping claws 33 located on the supporting arms 32, raising the anterior ends of the supporting arms 32. As a result, the engagement of the stopping claws 33 and the hook members 34 is released (see FIG. 13). That is, this releasing operation precedes the releasing operation of the spring holder 15 by the locking arm 11.

Finally, the locking arm 11 rises over the stopping protrusion 2 and reverts to its original position and the locking claw 13 moves away from the restraining wall 24. Consequently, the restraint of the spring holder 15 by the locking arm 11 is released. As a result, the spring force of the coiled springs 16 pushes the spring holder 15 backwards. The guiding rails 19 of the spring holder 15 and the groove members 20 of the female connector housing 5 fit together, guiding and allowing this backwards movement to occur smoothly. Moreover, the posterior end position of the groove members 20 regulates this backwards movement.

In this manner the fitting of the locking claw 13 and the stopping protrusion 2 locks the connector housings in a fitted state, and the electrical connection of the male and female terminal fittings is completed. Further, at this juncture, the coiled springs 16 regain almost their natural length due to the posterior movement of the spring holder 15 and, as a result, do not exert a separating force on the connector housings when the latter are in a completely fitted state.

Moreover, in the completely fitted state, the restraining wall 24 of the spring holder 15 is pushed onto the anterior end of the locking arm 11. This constitutes a double engagement of the stopping protrusion 2, and a more reliable locked state can thus be achieved.

When the two connector housings are to be separated, the coiled springs 16 are compressed and the spring holder 15 is simultaneously advanced. Meanwhile the supporting arms 32 are pushed in until they are again engaged by the hook members 34. As a result the restraining wall 24 of the spring holder 15 passes the location of the anterior end of the locking arm 11 and the spring holder 15 returns to its original location and, via the edge 22 of the releasing operating member 21, pushes the rising edge 12 of the locking arm 11. The anterior end of the locking arm 11 rises up and the locking claw 13 is released from the stopping protrusion 2. In this manner the female connector housing 5 and the male connector housing 1 can be separated.

Figure 15:
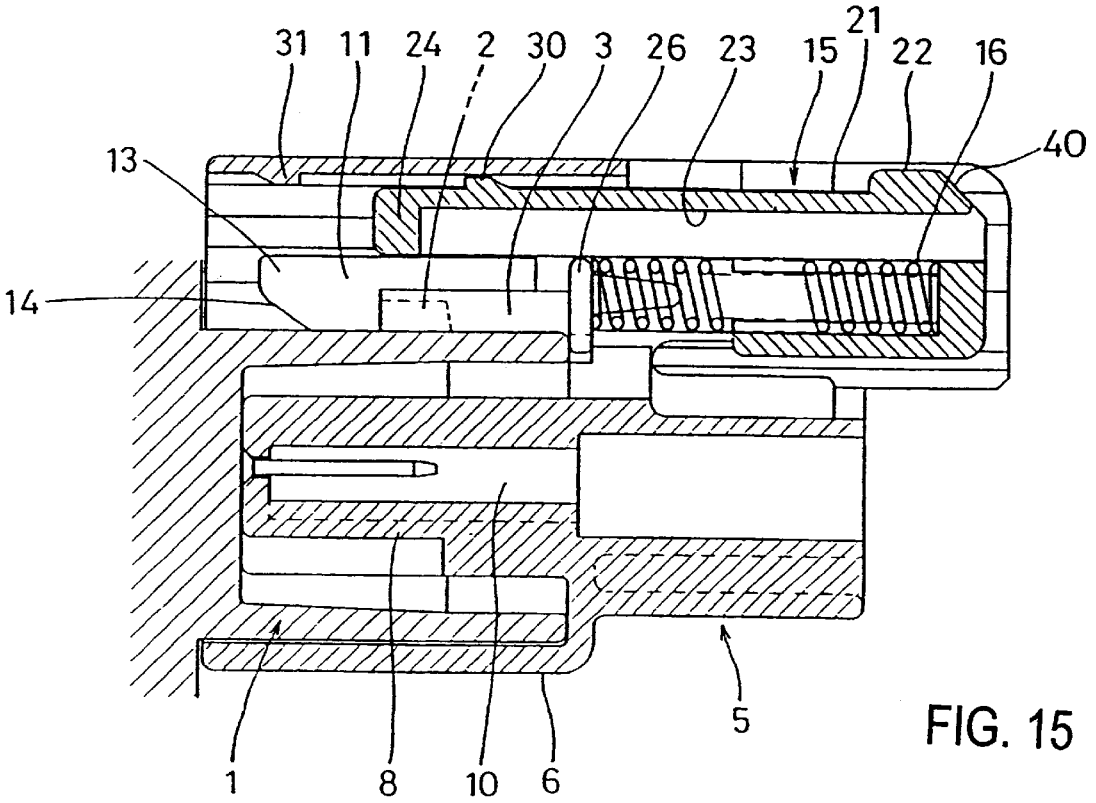
FIG. 15 is a cross-sectional view showing a completely fitted state.
Figure 16:
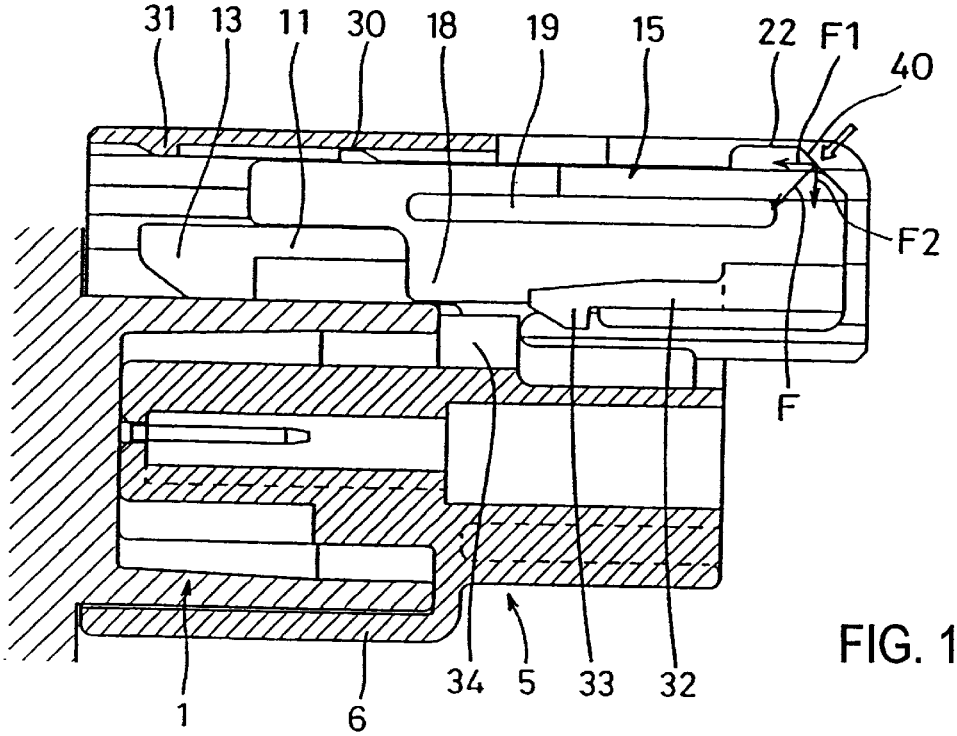
FIG. 16 is a cross-sectional view showing the supporting arm in the completely fitted state.

As shown in FIGS. 15 and 16, a pushing face 40 is formed on the posterior end (the free end) of the releasing operating member 21 provided on the spring holder 15, this pushing face 40 rising diagonally towards the operating edge 22. The function of the pushing face 40 is as follows. As shown in FIG. 16, when a pushing force F is exerted in a perpendicular manner on the pushing face 40, this pushing force F is divided into a component force F1 moving in an anterior direction, and a component force F2 moving in a downwards direction.

Figure 17A:
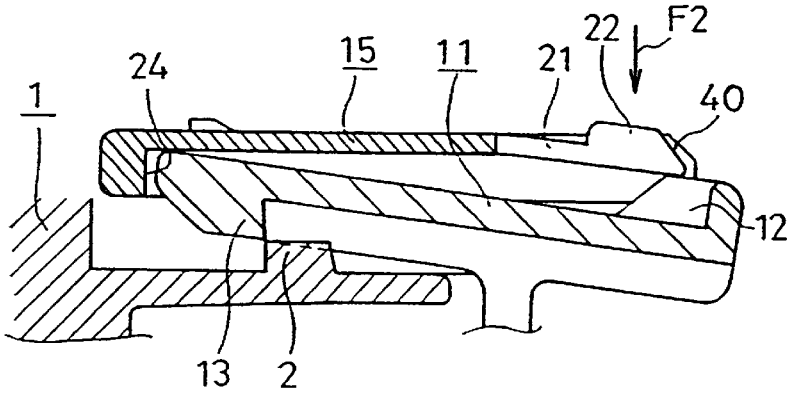
FIG. 17 is a partial cross-sectional view showing the function of a pushing face provided on a releasing operating member.
Figure 17B:
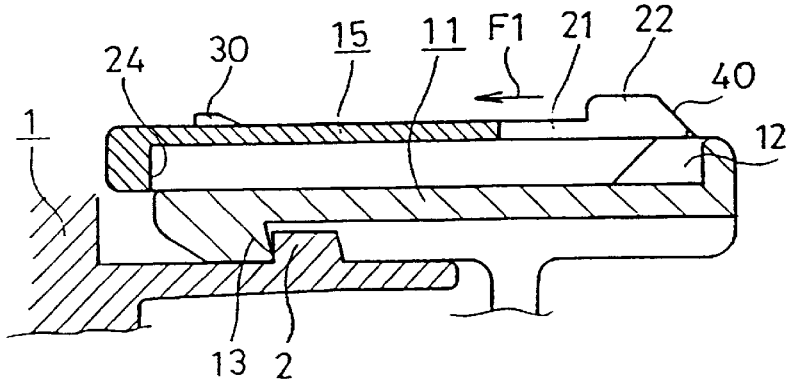

Consequently, when the two connector housings are to be separated, the pushing face 40 of the releasing operating member 21 is pushed in a perpendicular manner, and the anterior component force F1 is exerted first, compressing the coiled springs 16. Simultaneously, as shown in FIG. 17A, this pushes the spring holder 15 in an anterior direction, and the restraining wall 24 returns to its original location past the location of the anterior end of the locking arm 11. Next, as shown in FIG. 17B, the downwards component force F2 is exerted, the releasing operating member 21 being bent in a downwards direction and thereby pushing down the rising edge 12 of the locking arm 11. The anterior end of the locking arm 11 rises up and the locking claw 13 is released from the stopping protrusion 2.

In this manner the female connector housing 5 and the male connector housing 1 can be separated.

That is, when the diagonal pushing face 40 of the releasing operating member 21 is pushed in a perpendicular manner, this single action releases the bending prevention of the locking arm 11 and then forcefully bends the locking arm 11, thereby allowing the two connector housings to be separated easily.

According to the present embodiment, as described above, the spring force of the coiled springs 16 separates the two connector housings if the fitting operation of the connector housings is stopped before the two are completely fitted together and a half-fitted state can be detected as a result. Further, if the connector housings are fitted completely, the coiled springs 16 return to approximately their natural length and, as a result, the spring force does not exert a separating force on the connector housings when they are in a completely fitted state. Moreover, in the present configuration, the locking arm 11 and the coiled springs 16 which have been inserted into the spring holder 15 are all inserted into the female connector housing 5 and the male connector housing 1 is provided merely with the stopping protrusion 2 which stops the locking arm 11 (ribs 3 are provided in the present embodiment, but these could be omitted and a portion of the male connector housing could push the coiled springs 16). As a result there is little change required from the male connector housing 1 and the configuration currently in use. Consequently there is a greater degree of design freedom for this connector housing.

Further, in the present embodiment the spring holder 15 an move in can anterior-posterior direction, allowing fitting detection or release of the spring force. The fitting together of the guiding rails 19 and the groove members 20 allow this movement of the spring holder 15 to take place extremely smoothly.

Additionally, the spring holder 15 is provided with supporting arms 32 which restrain the backwards movement of the spring holder 15 until immediately prior to the completely fitted state being achieved. As a result, the spring holder 15 will not retreat inadvertently and accordingly its movement is reliable.

Next, a number of embodiments will be explained which further improve on the first embodiment.

Figure 18:
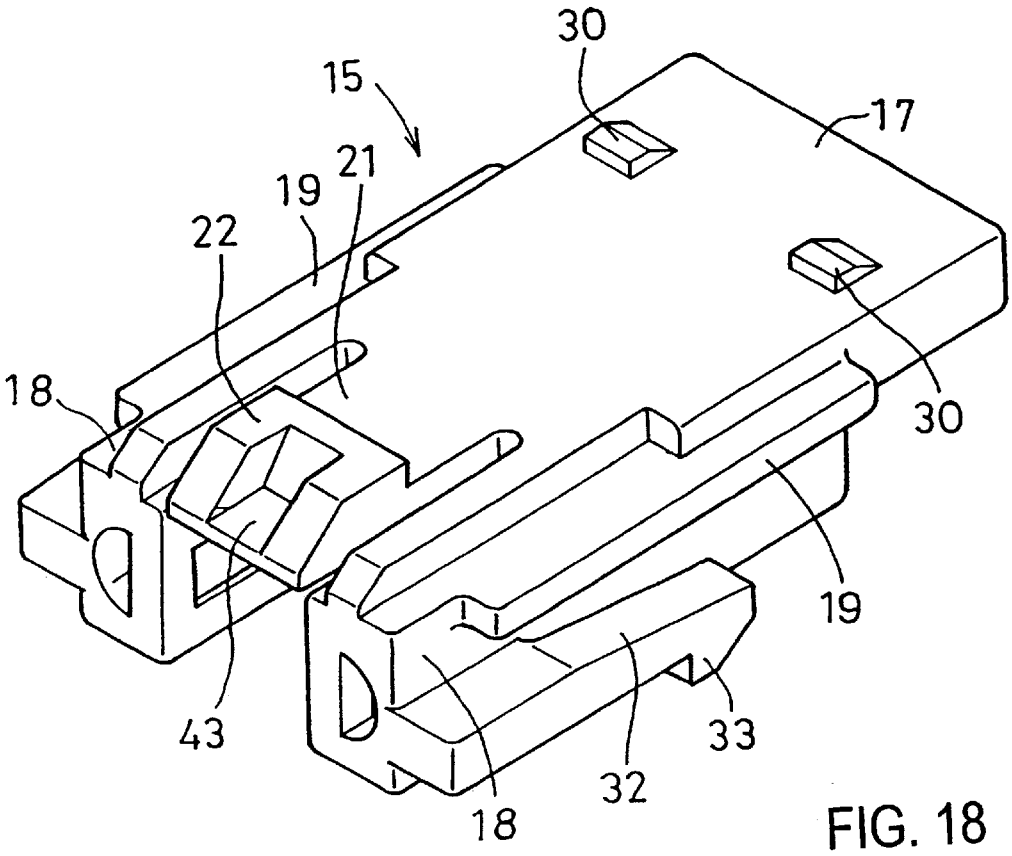
FIG. 18 is a diagonal view, seen from a rear face, of a spring holder of a second embodiment.
Figure 19:
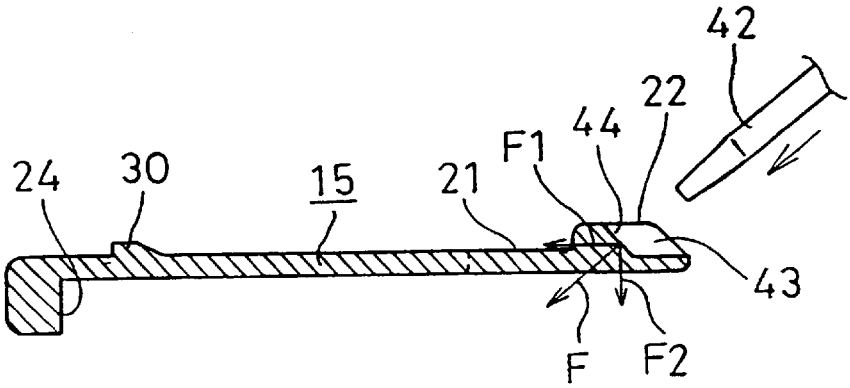
FIG. 19 is a partial cross-sectional view showing the finction of a contacting face provided on a jig hole.

FIGS. 18 and 19 show a second embodiment of the present invention. This second embodiment has a jig hole 43 opening onto the upper face of the posterior end of the releasing operating member 21 provided on the spring holder 15, this jig hole 43 allowing the insertion of a releasing jig 42 which consists of a small screwdriver or the like. A diagonal contacting face 44 extends from the bottom face of the jig hole 43. As shown in FIG. 19, when the jig 42 exerts a pushing force F in a direction perpendicular to the contacting face 44 this pushing force F is divided into a component force F1 moving in an anterior direction, and a component force F2 moving in a downwards direction.

Consequently, in the same manner as above, when the jig 42 pushes the contacting face 44 of the jig hole 43 in a perpendicular manner, the anterior component force F1 first pushes the spring holder 15 in an anterior direction and the bending regulation of the locking arm 11 is released. Then the downwards component force F2 pushes the posterior end of the locking arm 11 and forcefully bends the locking arm 11, releasing it from the stopping protrusion 2. In this manner the female connector housing 5 and the male connector housing 1 can be separated.

In the same way as above, when the contacting face 44 of the jig hole 43 provided on the releasing operating member 21 is pushed in a perpendicular manner by the jig 42, this single action releases the bending regulation of the locking arm 11 and then forcefully bends the locking arm 11, thereby allowing the two connector housings to be separately easily. Moreover, the use of the jig 42 allows the two connector housings to be separated easily in locations which are not easily accessible to the human hand, or in locations in which the coiled springs 16 installed in a multi-electrode connector have a strong spring force, etc.

Figure 20:
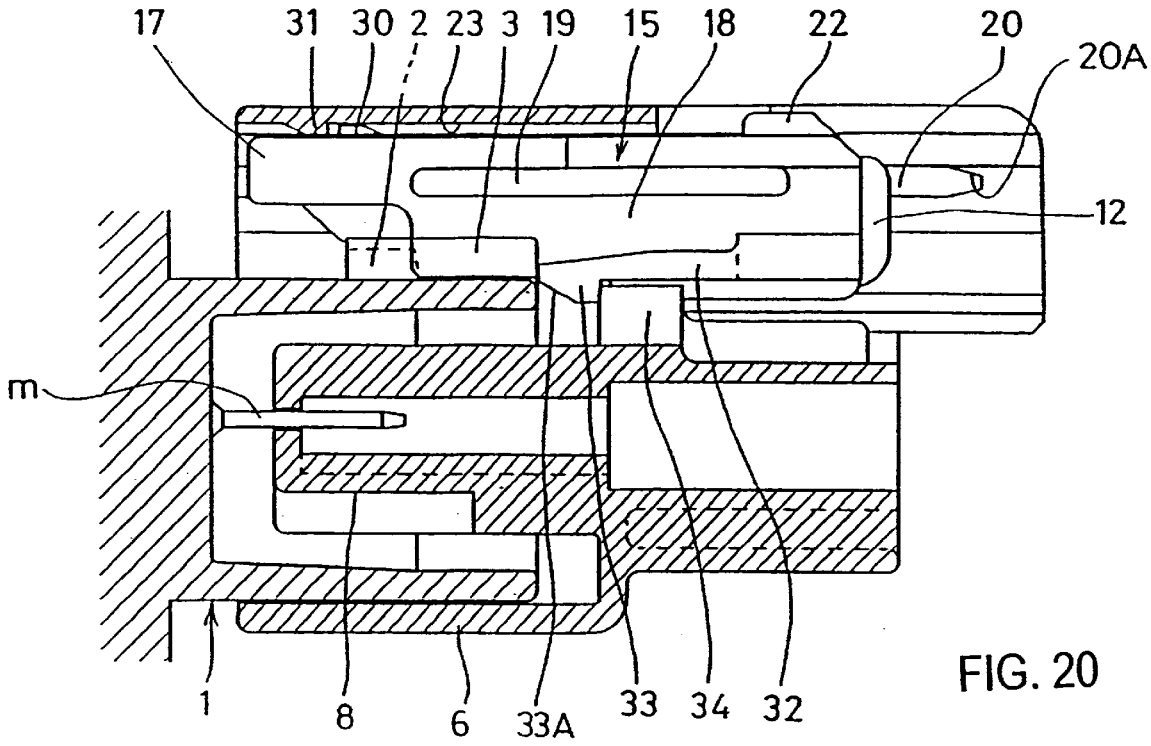
FIG. 20 is a cross-sectional view of the posterior end configuration of a groove member of a third embodiment.

Next, a third embodiment of the present invention is explained with the aid of FIGS. 20 and 21. When the two connector housings are in a completely fitted state and the resilient force of the coiled springs 16 pushes the spring holder 15 backwards, a component regulates this backwards movement. This third embodiment improves the configuration of that component. In the first embodiment, this backwards movement is regulated by the posterior ends of the guiding rails 19 of the spring holder 15 fitting with the posterior ends of the groove members 20 of the female connector housing 5. Consequently, there is the danger that the guiding rails 19 may have a large impact force on the posterior ends of the groove members 20 at the time they fit therewith, particularly when the coiled springs 16 have a strong spring force.

Figure 21A:
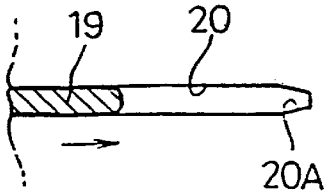
FIG. 21 is a schematic cross-sectional view showing backwards movement of a spring holder.
Figure 21B:
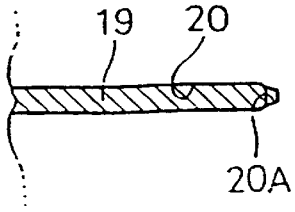

In order to avoid this problem, as shown in FIGS. 20 and 21, the present embodiment has guiding rails 19 which are of an identical width along their entire length whereas, in contrast, the posterior ends of the groove members 20 are tapered so as to become narrower along the width of the groove, eventually becoming narrower than the guiding rails 19. Consequently, when the coiled springs 16 are released from the restraints, their resilient force pushes the spring holder 15 backwards, that is, the guiding rails 19 are pushed backwards within the groove members 20 in the direction of the arrow in FIG. 21A and, as shown in FIG. 21B, the posterior end of each guiding rail 19 thrusts into a tapering member 20A at the posterior end of each groove member 20, and its backwards movement is thereby regulated. In this manner, the impact force of the guiding rails 19 when they make contact with the posterior end of the groove members 20 is absorbed, and damage to the spring holder 15 or the female connector housing 5 is prevented.

Figure 22:
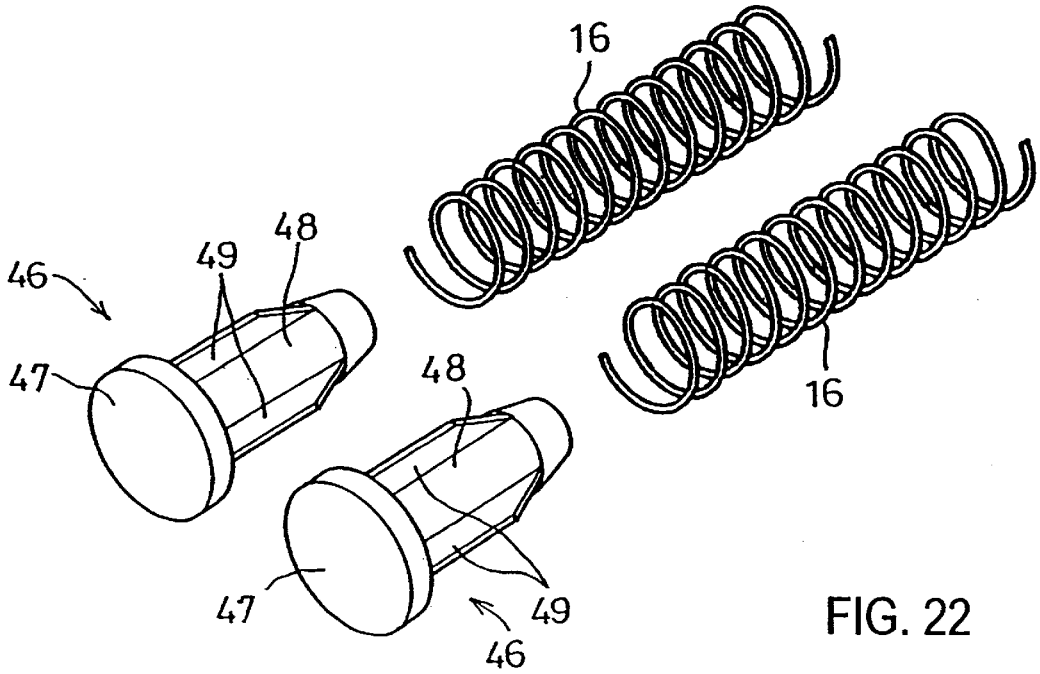
FIG. 22 is a diagonal view of coiled springs and spring seats of a fourth embodiment.
Figure 23:
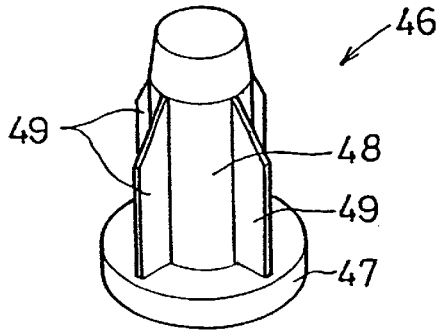
FIG. 23 is a diagonal view of a single spring seat.
Figure 24:
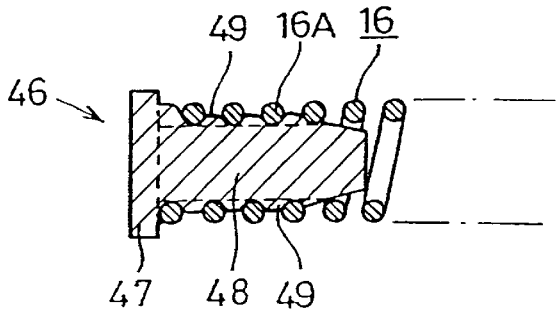
FIG. 24 is a sectional view of an assembled spring seat and coiled spring of the fourth embodiment.

A fourth embodiment of the present invention is explained with the aid of FIGS. 22 to 24. This fourth embodiment is improved by providing spring seats 46 which fit into the anterior ends of the coiled springs 16.

As shown in FIG. 22, this embodiment provides a spring seat 46 that can be fitted into the anterior end of each coiled spring 16. As shown in FIG. 23, each spring seat 46 has a disk member 47, a shank 48 protruding from one face thereof. This shank 48 fits tightly with the inner circumference of the coiled spring 16, and the tip thereof is tapered in order to serve as a guide. Four thin plate-shaped ribs 49, each being separated equi-angularly form the other, protrude outwards in a radial manner from the outer circumference of the straight portion of the shank 48. The anterior end of each rib 49 is also diagonally tapered in order to serve as a guide.

The spring seat 46 is attached by inserting the shank 48 into the inner circumference of the anterior end of the coiled spring 16. The diameter of the shank 48 is formed so as to fit tightly with the inner circumference of the coiled spring 16 and, consequently, the ribs 49 are squeezed as the shank 48 is inserted into the coiled spring 16. As FIG. 24 shows, this insertion stops when the disk member 47 makes contact with an anterior end face of the coiled spring 16, and the squeezed ribs 49 enter into the space between spirals 16A of the coiled spring 16.

The thin plate-shaped ribs 49 are squeezed as they are inserted and, as a result, the spring seats 46 can be attached using relatively little inserting force. Furthermore, the squeezed ribs 49 may enter into the entire space between the spirals 16A, thereby achieving a strong stopping force.

Further, in the case of the first embodiment, the two spring seats 28 are mutually linked by the joining member 29. This simplifies handling, but if, for example, the two connector housings are fitted together wrongly and the compressive force of each coiled spring 16 differs, the burden of torsion to the joining member 29 will increase, and this may lead to damage. In the present embodiment, however, an individual spring seat 46 fits into each of the two coiled springs 16, each of these spring seats 46 working individually on the attached coiled spring 16. Therefore an excessive burden is not exerted, and damage, etc. is prevented.

The present invention is not limited to the embodiments described above with the aid of figures. For example, the possibilities described below also lie within the technical range of the present invention. In addition, the present invention may be embodied in the following ways without deviating from the scope thereof.

(1) In the present embodiment the spring force of the coiled springs 16 is released by pushing back the spring holder 15. Instead, however, the coiled springs 16 may be provided with a restraining means which keeps the coiled springs 16 restrained from their posterior ends and which can release them, when the completely fitted state is reached. That is, it is possible to provide a restraining and releasing means which utilises the returning movement of the locking arm 11 carry out the restraining the release of the coil springs 16.

(2) The present embodiment uses coil springs 16. However, plate springs or other spring means may also be used.

(3) Further, the spring holder 15 anmd the locking arm 11 need not be provided on the female connector housing 5 but may equally well be provided on the male connector housing 1.

What is claimed is:

1. A connector housing of a male/female connector pair, the housing including a locking arm bendable from a rest condition to a bent condition on initial engagement with a locking member of a mating connector, and reverting to the rest condition on complete engagement of said locking arm and locking member, the housing further including a compression spring having one end engageable with a mating connector to urge said housing out of engagement therewith during partial fitting thereof, and a spring holder engaging the other end of said spring, the locking arm being engageable with the spring holder in the bent condition so that the spring holder moves with the locking arm in the fitting direction to compress the spring. and the spring holder being movable with respect to the housing from an advanced position to a retreated position on complete engagement of said locking arm and locking member thereby permitting compressive stress in said spring to be reduced.

2. A housing according to claim 1 wherein said spring holder further includes latching means engageable with said housing to maintain said spring holder in the advanced position, said latching means being released on complete engagement of said locking arm and locking member.

3. A housing according to claim 1 wherein said spring is a coil spring, said one end of said spring having a seat engaged therewith, and said seat being adapted to contact a mating connector.

4. A housing according to claim 1 herein said spring holder and housing are guided with respect to each other by opposite ribs of one of the spring holder and housing, and opposite channels of the other of the spring holder and housing, said channels and ribs interengaging.

5. A housing according to claim 4 wherein said channels are narrowed at the end thereof corresponding to the retreated position.

6. A housing according to claim 1 and having a plurality of compression springs, an individual spring seat being provided for each spring.

7. A housing according to claim 6 wherein said seat comprises a shank to fit from one end of the spring within the coils thereof, the shank having a plurality of outwardly extending deformable ribs engageable tightly with said coils.

8. A housing according to claim 1 wherein said spring holder overlies said locking arm and has a bendable member adapted to contact an abutment of said locking arm, to bend said locking arm from the rest to the bent condition.

9. A housing according to claim 8 wherein said bendable member includes a pushing face for receiving a bend inducing force, the plane of said face intersecting the direction of movement of said spring holder and the direction of movement of said abutment.

10. A housing according to claim 9 wherein said bendable member includes a recess within which is located said pushing face said recess being adapted to guide an elongate release tool.

11. A housing according to claim 1 wherein said spring holder includes a bending regulating member adapted to prevent bending of said locking arm from the rest condition on complete engagement of said locking arm and locking member.

12. A housing according to claim 11 wherein said spring holder overlies said locking arm and has a bendable member adapted to contact an abutment of said locking arm, to bend said locking arm from the rest to the bent condition.

13. A housing according to claim 12 wherein said bendable member includes a pushing face for receiving a bend inducing force, the plane of said face intersecting the direction of movement of said spring holder and the direction of movement of said abutment.

14. A housing according to claim 13 wherein said bendable member includes a recess within which is located said pushing face said recess being adapted to guide an elongate release tool.

* * * * *